US007101275B2

(12) United States Patent
Roberts et al.

(10) Patent No.: US 7,101,275 B2
(45) Date of Patent: Sep. 5, 2006

(54) RESILIENT POLISHING PAD FOR CHEMICAL MECHANICAL POLISHING

(75) Inventors: John V. H. Roberts, Newark, DE (US); Laurent S. Vesier, Bear, DE (US)

(73) Assignee: Rohm and Haas Electronic Materials CMP Holdings, Inc., Newark, DE (US)

( * ) Notice: Subject to any disclaimer, the term of this patent is extended or adjusted under 35 U.S.C. 154(b) by 64 days.

(21) Appl. No.: 10/673,002

(22) Filed: Sep. 26, 2003

(65) Prior Publication Data

US 2005/0070216 A1 Mar. 31, 2005

(51) Int. Cl.
*B24B 33/00* (2006.01)

(52) U.S. Cl. ..... 451/533; 451/539

(58) Field of Classification Search ..... 451/533, 451/539; 428/346, 412; 438/346, 412
See application file for complete search history.

(56) References Cited

U.S. PATENT DOCUMENTS 4,788,798 A * 12/1988 DeFranco et al. ..... 451/538
5,257,478 A 11/1993 Hyde et al.
5,692,950 A * 12/1997 Rutherford et al. ..... 451/552
6,007,407 A 12/1999 Rutherford et al.
2004/0102137 A1* 5/2004 Allison et al. ..... 451/28

FOREIGN PATENT DOCUMENTS

EP 1 046 466 A2 10/2000

* cited by examiner

*Primary Examiner*—M. Rachuba
(74) *Attorney, Agent, or Firm*—Edwin Oh

(57) ABSTRACT

A resilient, laminated polishing pad for chemical mechanical polishing is disclosed. The polishing pad includes a base layer and a polishing layer bonded by a hot-melt adhesive. The hot-melt adhesive of the present invention provides a Tpeel strength for the polishing pad of at least greater than 40 Newtons at 305 mm/min, reducing pad delamination.

7 Claims, 3 Drawing Sheets

RESILIENT POLISHING PAD FOR CHEMICAL MECHANICAL POLISHING

BACKGROUND OF THE INVENTION

The present invention relates to polishing pads for chemical mechanical polishing of substrates, and in particular, relates to resilient, laminated polishing pads and methods therefor.

In the fabrication of integrated circuits and other electronic devices, multiple layers of conducting, semiconducting, and dielectric materials are deposited on or removed from a surface of a semiconductor wafer. Thin layers of conducting, semiconducting, and dielectric materials may be deposited by a number of deposition techniques. Common deposition techniques in modem processing include physical vapor deposition (PVD), also known as sputtering, chemical vapor deposition (CVD), plasma-enhanced chemical vapor deposition (PECVD), and electrochemical plating (ECP).

As layers of materials are sequentially deposited and removed, the uppermost surface of the wafer becomes non-planar. Because subsequent semiconductor processing (e.g., metallization) requires the wafer to have a flat surface, the wafer needs to be planarized. Planarization is useful in removing undesired surface topography and surface defects, such as rough surfaces, agglomerated materials, crystal lattice damages, scratches, and contaminated layers or materials.

Chemical mechanical planarization, or chemical mechanical polishing (CMP), is a common technique used to planarize substrates such as semiconductor wafers. In conventional CMP, a wafer is mounted on a carrier assembly and positioned in contact with a polishing pad in a CMP apparatus. The carrier assembly provides a controllable pressure to the wafer, pressing it against the polishing pad. The pad is optionally moved (e.g., rotated) relative to the wafer by an external driving force. Simultaneously therewith, a chemical composition or other fluid medium ("slurry") is flowed onto the polishing pad and into the gap between the wafer and the polishing pad. The wafer surface is thus polished and made planar by the chemical and mechanical action of the pad surface and slurry.

Rutherford et al., in U.S. Pat. No. 6,007,407, discloses polishing pads for performing CMP that are formed by laminating two layers of different materials. The typical two-layer polishing pad includes an upper polishing layer formed of a material, such as, polyurethane suitable for polishing the surface of a substrate in the presence of a polishing solution (e.g., slurry). The upper polishing layer is attached to a lower layer or "sub-pad" formed from a material suitable for supporting the polishing layer. The sub-pad typically has higher compressibility and lower stiffness than the polishing layer and essentially acts as supporting "cushions" for the polishing layer. Conventionally, the two layers are bonded with a pressure-sensitive adhesive ("PSA"). However, PSAs have relatively low bonding strength and marginal chemical resistance. Consequently, a laminated polishing pad utilizing PSAs tend to cause the sub-pad to separate ("delaminate") from the upper polishing layer, or vice versa, during polishing, rendering the pad useless and impeding the polishing process.

Also, certain polishing pads for performing CMP have windows formed therein. These windows allow light from an in-situ end point detection measurement system to reach the wafer being polished to monitor the polishing process. Pad windows need to be strongly bonded to the pads, otherwise they can also separate from the sub-pad and/or polishing layer and become damaged, rendering the pad and the window useless.

Therefore, what is needed is a polishing pad for chemical mechanical polishing, including polishing pads with windows, which resists delamination and are cost effective to manufacture.

STATEMENT OF THE INVENTION

A resilient, laminated polishing pad for chemical mechanical polishing is disclosed. The polishing pad includes a base layer and a polishing layer bonded by a hot-melt adhesive. The hot-melt adhesive of the present invention provides a Tpeel strength for the polishing pad of at least greater than 40 Newtons at 305 mm/min, reducing pad delamination.

In one aspect, the present invention provides a laminated polishing pad for chemical mechanical polishing, the polishing pad comprising: a base layer; a polishing layer overlying the base layer; and a hot-melt adhesive layer, interposed between the base layer and the polishing layer, the adhesive layer bonding the base layer to the polishing layer, wherein a Tpeel strength of the bonding is at least greater than 40 Newtons at 305 mm/min.

In a second aspect, the present invention provides a laminated polishing pad for chemical mechanical polishing, the polishing pad comprising: a base layer having a first opening; a polishing layer overlying the base layer, the polishing layer having a second opening wider than the first opening; a window formed in the second opening; and a hot-melt adhesive layer, interposed between the base layer, the polishing layer and the window, the adhesive layer bonding the base layer to the polishing layer and the window, wherein a Tpeel strength of the bonding is at least greater than 40 Newtons at 305 mm/min.

In a third aspect, the present invention provides a laminated polishing pad for chemical mechanical polishing, the polishing pad comprising: a polymer impregnated felt base layer having a first opening; a filled polymer sheet polishing layer overlying the base layer, the polishing layer having a second opening wider than the first opening; a window formed in the second opening; and a hot-melt adhesive layer, interposed between the base layer, the polishing layer and the window, the adhesive layer bonding the base layer to the polishing layer and the window, wherein a Tpeel strength of the bonding is at least greater than 40 Newtons at 305 mm/min.

In a fourth aspect, the present invention provides a method of forming a laminated polishing pad for chemical mechanical polishing, the method comprising: providing a base layer; providing a polishing layer; depositing a hot-melt adhesive on the base layer or the polishing layer; interposing the base layer to the polishing layer with the hot-melt adhesive before the hot-melt adhesive sets; and setting the hot-melt adhesive to bond the base layer to the polishing layer, wherein a Tpeel strength of the bond is at least greater than 40 Newtons at 305 mm/min.

In a fifth aspect, the present invention provides a method of forming a laminated polishing pad for chemical mechanical polishing, the method comprising: providing a base layer having a first opening; providing a polishing layer having a second opening wider than the first opening; depositing a hot-melt adhesive on the base layer; interposing the base layer to the polishing layer with the hot-melt adhesive before the hot-melt adhesive sets; providing a window in the second opening and on the hot-melt adhesive before the hot-melt adhesive sets; and setting the hot-melt adhesive to bond the base layer to the polishing layer and the window, wherein a Tpeel strength of the bond is greater than 40 Newtons at 305 mm/min.

DETAILED DESCRIPTION OF THE INVENTION

Figure 1:
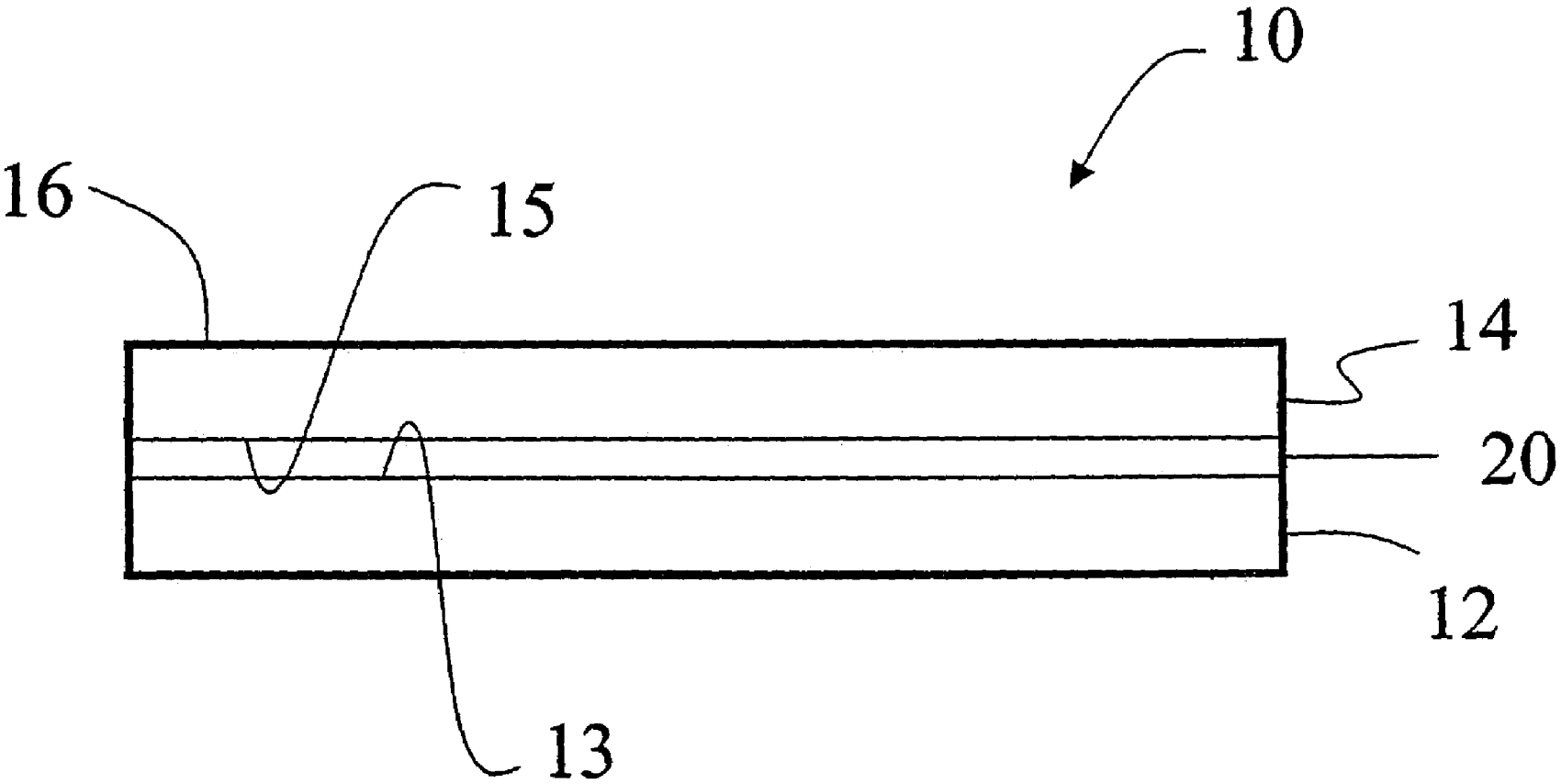
FIG. 1 illustrates a cross-sectional view of an embodiment of the laminated polishing pad of the present invention.

Referring now to the drawings, FIG. 1 illustrates a polishing pad 10 that includes a base layer 12 with a top surface 13, and an upper polishing layer 14 with a bottom surface 15 and a top polishing surface 16. Base layer 12 can be made of, for example, polymer impregnated felt (e.g., Suba IV™ by Rodel, Inc. of Newark, Del.) or filled polymeric sheets. Further, in an example embodiment, upper polishing layer 14 can be made of polymer impregnated felts, poromerics, filled polymer sheets (e.g., IC1000™ by Rodel, Inc. of Newark, Del.), or unfilled textured polymers.

Polishing pad 10 also includes a hot-melt adhesive layer 20 that bonds base layer 12 to polishing layer 14. In an example embodiment, hot-melt adhesive layer 20 is an inexpensive and readily available, thermoplastic or thermoset material. In particular, adhesive layer 20 is a material selected from the following group of hot-melt adhesives: polyolefins, ethylene vinyl acetate, polyamides, polyesters, polyurethanes, polyvinyl chloride and epoxies. In an example embodiment, hot-melt adhesive layer 20 has a thickness in the range of about $2.54\times10^{-4}$ cm to about $6.35\times10^{-2}$ cm (0.1 mils to 25 mils).

Polishing pad 10 may be formed by applying a hot-melt adhesive layer 20 to either the top surface 13 or the bottom surface 15. For example, a roller-coater can be charged with the hot-melt adhesive 20 and then, either base layer 12 or polishing layer 14 is run through the coater, thereby depositing the hot-melt adhesive 20 on the bottom surface 15 or top surface 13. The hot-melt adhesive 20 is applied at a temperature that will not damage the base layer 12 or the polishing layer 14. For example, the adhesive 20 is applied at about 50° C. to about 150° C. The base layer 12 and polishing pad layer 14 are then interposed and pressed together before the hot-melt adhesive 20 sets. Preferably, the hot-melt adhesive is one that solidifies (sets) in about 10 seconds to about 3 minutes to achieve a quick bond between the base layer 12 and the polishing layer 14. This time period is referred to as the adhesive's "open time." Note, the adhesive's "open time" may be considerably longer, for example, for about 1 hour to 3 days, depending on the adhesive utilized. In any event, the adhesive 20 provides a much stronger bond than the bond created by conventional pressure-sensitive adhesives (discussed further below).

Figure 2:
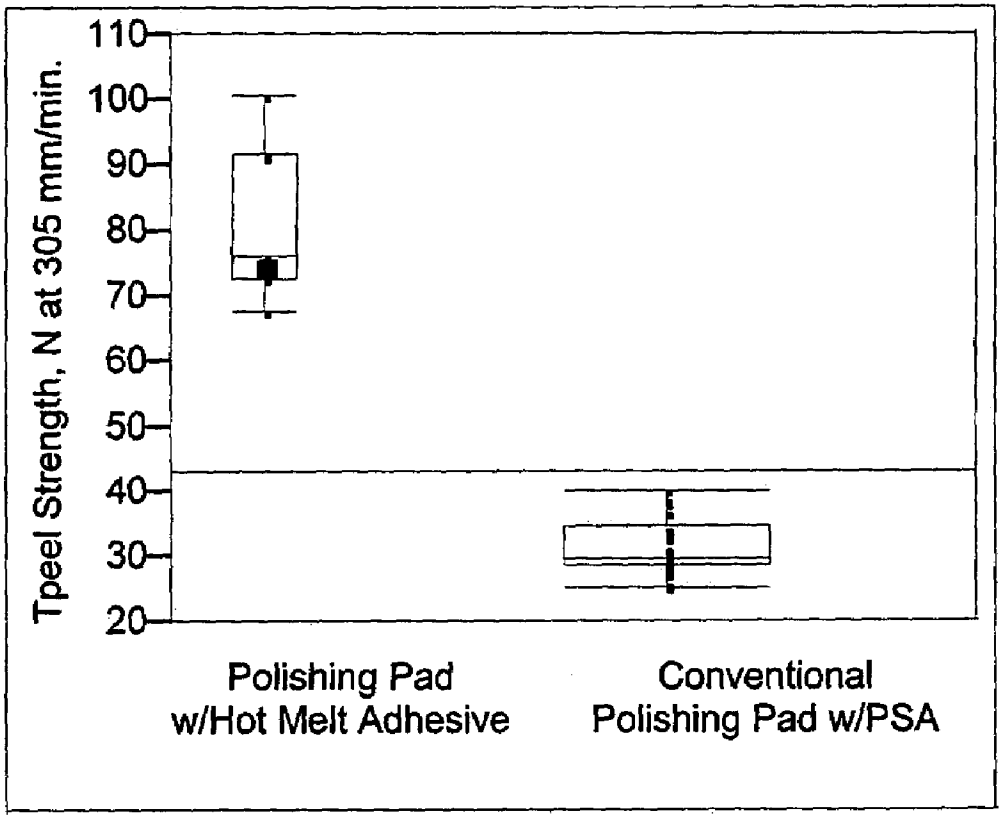
FIG. 2 illustrates a Tpeel strength analysis of the laminated polishing pad of the present invention.

Referring now to FIG. 2, there is shown a comparison of a one-way analysis of Tpeel strength, measured in Newtons at a rate of 305 mm/min., of the polishing pad of the present invention with a hot-melt adhesive layer and a conventional polishing pad with a PSA. The hot-melt adhesive utilized for this example is Mor-Melt™ R-5003, commercially available from Rohm and Haas. The Tpeel test was performed as described in ASTM D1876. As shown in FIG. 2, the Tpeel strength of the polishing pad utilizing the hot melt adhesive 20 of the present invention is about 68 Newtons to about 100 Newtons at 305 mm/min. In contrast, the Tpeel strength of the conventional polishing pad utilizing a conventional PSA is only between 25 Newtons to 40 Newtons at 305 mm/min. In other words, the Tpeel strength of the bond between base layer 12 and the polishing layer 14 of the polishing pad 10 utilizing the hot melt adhesive 20 of the present invention is at least greater than 40 Newtons at 305 mm/min.

Advantageously, the use of hot-melt adhesive layer 20 in forming polishing pad 10 provides a more resilient polishing pad than prior art pads formed conventionally using pressure-sensitive adhesives. In particular, pad 10 is more resilient to the chemical and mechanical action associated with the polishing process, having a Tpeel strength, of the bond between base layer 12 and the polishing layer 14, of at least greater than 40 Newtons at 305 mm/min.

Figure 3:
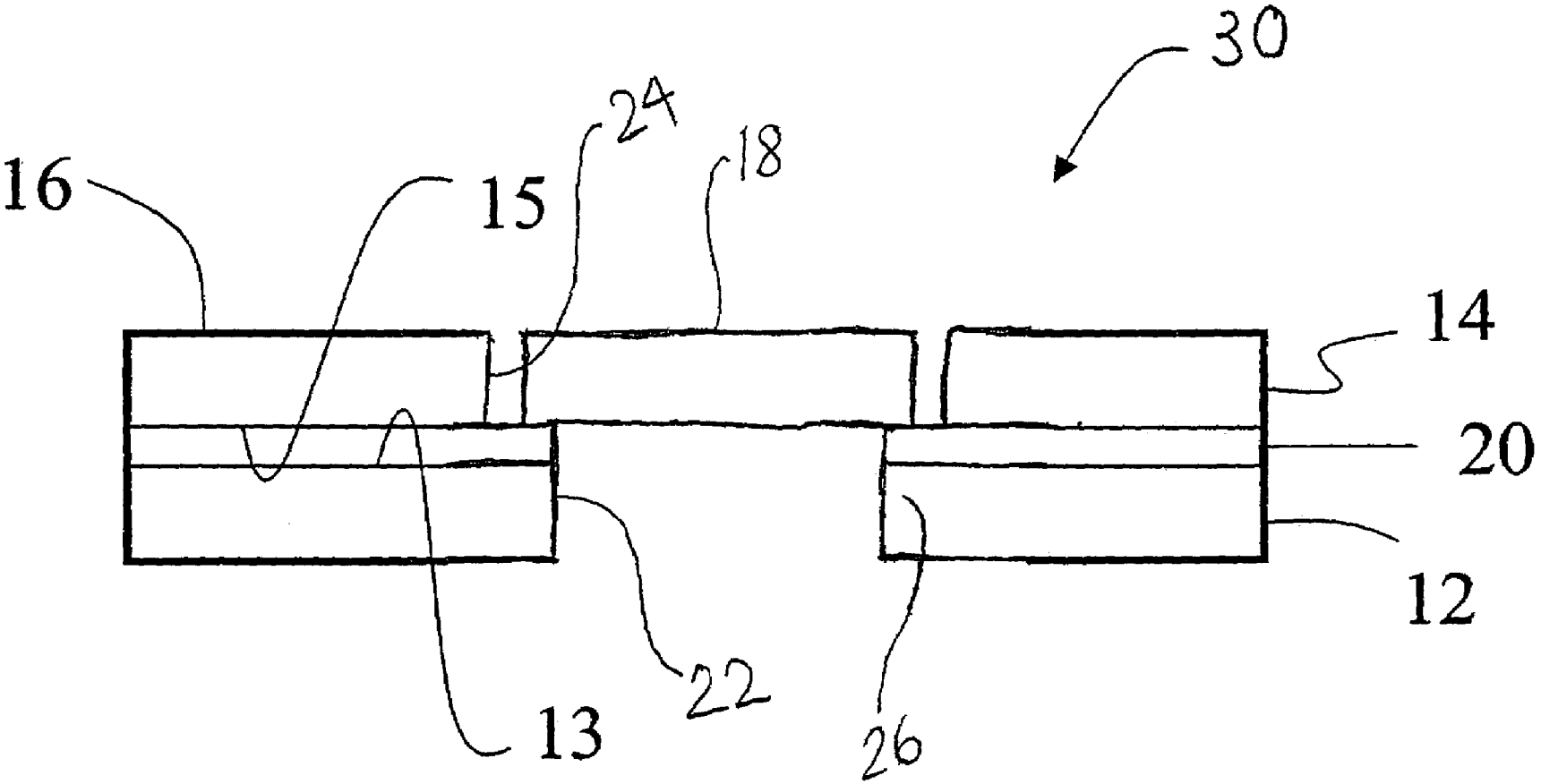
FIG. 3 illustrates a cross-sectional view of another embodiment of the laminated polishing pad of the present invention.

Referring now to FIG. 3, there is shown another embodiment of the present invention comprising a transparent window 18 disposed in an opening 24 in the polishing layer 14. The transparent window 18 is made of an optically transmissive, or light-transmissive, material to permit an optical beam from a known optical equipment or apparatus (not shown) to pass through the polishing pad 30 while the polishing pad 30 is used to polish a workpiece.

The opening 24 extends through the thickness of the polishing layer 14 from the top polishing surface 16 to the bottom surface 15, and the transparent window 18 lies in the opening 24 within this thickness. The opening 24 is axially aligned above an opening 22 that extends through the thickness of the base layer 12. The opening 22 is narrower than the width of the opening 24. The base layer 12 around a periphery of the opening 22 forms a circumferential ledge 26 that serves as a seat for the transparent window 18.

Base layer 12 can be made of a polymer impregnated felt (e.g., Suba IV™ by Rodel, Inc. of Newark, Del.) or filled polymeric sheets. Further, in an example embodiment, upper polishing layer 14 can be made of polymer impregnated felts, poromerics, filled polymer sheets (e.g., IC1000™ by Rodel, Inc. of Newark, Del.), or unfilled textured polymers.

Polishing pad 30 also includes a hot-melt adhesive layer 20 that bonds polishing layer 14 and window 18, to base layer 12. Advantageously, adhesive 20 forms bond seals with the window 18. The bond seals resist wetting by the polishing medium at an interface between the adhesive 20 and the window 18 to prevent contamination by the polishing medium into the opening 22. Note, the space or gap between window 18 and polishing layer 14 is shown for illustrative purposes only. In practice, window 18 would sit substantially flush in the opening 24, thereby limiting contamination by the polishing medium into opening 22. In this regard, adhesive 20 provides additional protection from contamination. Furthermore, although the present embodiment is described with respect to a transparent window 18 for end-point detection purposes, the entirety of the polishing pad 14 may itself be optically transmissive as well to serve the same function.

Hot-melt adhesive layer 20 is a thermoplastic or thermoset material. In particular, adhesive layer 20 is a material selected from the following group of hot-melt adhesives: polyolefins, ethylene vinyl acetate, polyamides, polyesters, polyurethanes, polyvinyl chloride and epoxies. In an example embodiment, hot-melt adhesive layer 20 has a thickness in the range of about $2.54\times10^{-4}$ cm to about $6.35\times10^{-2}$ cm (0.1 mils to 25 mils).

Polishing pad 30 may be formed by applying a hot-melt adhesive layer 20 to the top surface 13. The hot-melt adhesive 20 is applied at a temperature that will not damage the base layer 12 or the polishing layer 14. For example, the adhesive 20 is applied at about 50° C. to about 150° C. The base layer 12 and polishing pad layer 14 are then interposed and pressed together before the hot-melt adhesive 20 sets. Also, in an example embodiment, the hot-melt adhesive solidifies (sets) in about 10 seconds to about 3 minutes to achieve a quick bond between the base layer 12 to the polishing layer 14. Furthermore, window 18, for example, is fitted into the opening 24 of polishing pad layer 14 and adhered to the adhesive 20 before it sets. Note, as discussed above, the adhesive's "open time" may last for several minutes to several days depending on the particular adhesive utilized. Nonetheless, the bond between the base layer 12 and the polishing pad layer 14 of the polishing pad 30 has a Tpeel strength of at least greater than 40 Newtons at 305 mm/min.

Advantageously, the use of hot-melt adhesive layer 20 in forming polishing pad 30 provides a more resilient polishing pad than prior art pads formed conventionally using pressure-sensitive adhesives. In particular, pad 30 is more resilient to the chemical and mechanical action associated with the polishing process, having a Tpeel strength, of the bond between base layer 12 and the polishing layer 14, of at least greater than 40 Newtons at 305 mm/min.

What is claimed is:

1. A laminated polishing pad for chemical mechanical polishing, the polishing pad comprising:

a base layer;

a polishing layer overlying the base layer; and a hot-melt adhesive layer, interposed between the base layer and the polishing layer, the adhesive layer bonding the base layer to the polishing layer, wherein a Tpeel strength of the bonding is at least greater than 40 Newtons at 305 mm/min.

2. The polishing pad of claim 1, wherein the Tpeel strength of said bonding is at least greater than 68 Newtons at 305 mm/min.

3. The polishing pad of claim 1, wherein the base layer is selected from the group consisting of: polymer impregnated felts or filled polymer sheets.

4. The polishing pad of claim 1, wherein the polishing layer is selected from the group consisting of: polymer impregnated felts, poromerics, filled polymer sheets, and unfilled textured polymers.

5. The polishing pad of claim 1, wherein the hot-melt adhesive is selected from the group consisting of: polyolefins, ethylene vinyl acetate, polyamides, polyesters, polyurethanes, polyvinyl chloride and epoxies.

6. The polishing pad of claim 1, wherein the hot-melt adhesive layer has a thickness in the range of $2.54\times10^{-4}$ cm to $6.35\times10^{-2}$ cm.

7. A method of forming a laminated polishing pad for chemical mechanical polishing, the method comprising:

providing a base layer;

providing a polishing layer;

depositing a hot-melt adhesive on the base layer or the polishing layer;

interposing the base layer to the polishing layer with the hot-melt adhesive before the hot-melt adhesive sets; and setting the hot-melt adhesive to bond the base layer to the polishing layer, wherein a Tpeel strength of the bond is at least greater than 40 Newtons at 305 mm/min.

* * * * *